United States Patent [19]

Penterson et al.

[11] Patent Number: 4,517,904

[45] Date of Patent: May 21, 1985

[54] FURNACE, BURNER AND METHOD FOR BURNING PULVERIZED COAL

[75] Inventors: Craig A. Penterson, Sutton; Donald S. Langille, Worcester, both of Mass.

[73] Assignee: Riley Stoker Corporation, Worcester, Mass.

[21] Appl. No.: 584,484

[22] Filed: Feb. 28, 1984

[51] Int. Cl.[3] ..... F23D 1/02

[52] U.S. Cl. ..... 110/264; 110/265; 110/347

[58] Field of Search ..... 110/263, 264, 265, 347; 431/183, 184

[56] References Cited

U.S. PATENT DOCUMENTS

| | | | |
|---|---|---|---|
| 3,788,796 | 1/1974 | Krippene et al. | 110/264 X |
| 4,223,615 | 9/1980 | Breen et al. | 110/264 |
| 4,381,718 | 5/1983 | Carver et al. | 110/347 |
| 4,422,391 | 12/1983 | Izuha et al. | 110/347 |
| 4,457,241 | 7/1984 | Itse et al. | 110/264 X |

*Primary Examiner*—Edward G. Favors

*Attorney, Agent, or Firm*—Mason, Kolehmainen, Rathburn & Wyss

[57] ABSTRACT

A furnace, a burner and a method for burning pulverized coal in a highly efficient and precisely controlled manner includes a tubular nozzle with a venturi flow control adjacent the outlet for directing a primary air and coal mixture into a primary combustion zone of the furnace for burning. A coal spreader is mounted in the divergent outlet section of the venturi and swirl vanes on the spreader divide and form the stream into plurality of fuel rich and fuel lean streams discharged into the combustion zone. A tubular conduit in coaxial alignment around the coal nozzle directs a swirling flow of secondary air into the combustion zone around the primary combustion zone and a plurality of tertiary air conduits spaced outwardly of the secondary air conduit are provide to introduce directionally controllable streams of tertiary air into the combustion zone. Each tertiary conduit includes an outlet port for discharging a stream of tertiary air and includes vane means movable to direct the stream of air into or away from the primary combustion zone for improved $NO_x$ control and combustion performance.

19 Claims, 8 Drawing Figures

FURNACE, BURNER AND METHOD FOR BURNING PULVERIZED COAL

BACKGROUND OF THE INVENTION

1. Field of the Invention

The present invention relates to a new and improved furnace, a burner and a method for burning pulverized coal in a highly efficient and controlled manner to reduce and minimize the formation of oxides of nitrogen and other pollutants in the burning process. The present invention is an improvement of the burner and method of co-pending U.S. patent applications Ser. Nos. 469,019 and 469,117, filed Feb. 23, 1983, and assigned to the same assignee as the present application. 2. Description of the Prior Art Over the years a wide variety of burner and furnace designs have been developed for handling pulverized coal in burning the coal. One of the main concerns in firing pulverized coal and other fossil fuels is the unwanted production of oxides of nitrogen (known as $NO_x$) in the combustion process.

A number of articles and reports have been published concerning oxides of nitrogen as pollutants and concerning burner and furnace designs. These articles and reports also deal with methods for reducing and controlling the formation of $NO_x$ and are listed as follows:

Itse, D. C. and Penterson C. A., "$NO_x$ Control Technology For Industrial Combustion Systems", The American Flame Research Committee Symposium On Combustion Diagnostics From Fuel Bunker To Stack, Oct. 5, 1983.

Claypole, T. C., Syred, N., "The Effect of Swirl Burner Aerodynamics On $NO_x$ Formation", Eighteenth Symposium on Combustion, The Combustion Institute, 1981.

Lisauskas, R. A., Rawdon, A. H., "Status of $NO_x$ Control for Riley Stoker Wall-Fired and TURBO Furnaces", EPA-EPRI Joint Symposium on Stationary Combustion $NO_x$ Control, 1982.

Roberts, P. A., "Near Field Aerodynamics Research Program", International Flame Research Foundation, 1983.

Rawdon, A. H., Johnson, S. A., "Application of $NO_x$ Control Technology to Power Boilers", 1973 American Power Conference.

Lisauskas, R. A., Marshall J. J., "An Evaluation of $NO_x$ Emissions from Coal-fired Steam Generators", 1980 EPA/EPRI Joint Symposium on Stationary Combustion $NO_x$ Control.

Lim, K. J., Milligan, R. J., Lips, H. I., Castaldini, C., Merrill, R. S. and Mason, H. B., "Technology Assessment Report for Industrial Boiler Applications: $NO_x$ Combustion Modification," Acurex Corporation for Environmental Protection Agency, EPA-600/7-79-178f, Research Triangle Park, N.C., December, 1979.

Heap, M. P., Lowes, T. M., Walmsley, R., Bartelds, H. and LeVaguerese, P., "Burner Criteria for $NO_x$ Control, Volume 1, Influence of Burner Variables on $NO_x$ in Pulverized Coal Flames," International Flame Research Foundation, EPA-600/2-76-061a, March, 1976.

Brown, R. A., Mason, H. B., Schreiber, R. J., "Systems Analysis Requirements for Nitrogen Oxide Control of Stationary Sources." NTIS-PB-237-367, EPA-650/2-74-091, September, 1974.

Information presented at the Third Technical Panel Meeting, "EPA Low $NO_x$ Burner Technology and Fuels Characterization," Newport Beach, Calif., November, 1979.

Beer, J. M., and Chigier, N. A., "Combustion Aerodynamics" Applied Science Publishers, 1972.

DyKema, O. W., "Analysis of Test Data for $NO_x$ Control in Coal Fired Utility Boilers," Aerospace Corporation for Environmental Protection Agency, EPA 600/2-76-274 (NTIS No. PB 261 066,) Research Triangle Park, N.C., October, 1976.

Martin, G. B. and Bowen J. S., "$NO_x$ Control Overview, International Symposium on $NO_x$ Reduction in Industrial Boilers, Heaters and Furnaces," Houston, Tex., Oct. 22–23, 1979.

Rawdon, A. H. and Johnson, S. A. "Application of $NO_x$ Control Technology to Power Boilers," Proceedings of the American Power Conference, Vol. 35, pp. 828–837, 1973.

Rawdon, A. H., Lisauskas, R. A., Zone, F. J., "Design and Operation of Coal-Fired Turbo R Furnaces for $NO_x$ Control," presented at the Second EPRI $NO_x$ Technology Seminar, Denver, Col., November, 1978.

Brown, R. A., "Alternate Fuels and Low $NO_x$ Tangential Burner Development Program," proceedings of the Third Stationary Source Combustion Symposium Volume II, Advanced Processes and Special Topics, Acurex Corporation for Environmental Protection Agency, EPA-600/7-79-0506, Research Triangle Park, N.C., February 1979.

Zeldovich, J., "Acta Physicochimica U.R.S.S.," Volume 21, No. 4, 577, 1946.

Pershing, D. W., Brown, J. W., Martin, G. B. Berkau, E. E., "Influence of Design Variables on the Production of Thermal and Fuel $NO_x$ from Residual Oil and Coal Combustion," presented at the 66th Annual AICHe Meeting, Philadelphia, Pa., November, 1973.

Penterson, C. A., "Development of an Economical Low $NO_x$ Firing System For Coal Fired Steam Generators, 1982 Joint Power Generation Conference, Denver, Col., Oct. 17–21, 1982.

In addition, the following U.S. patents are directed towards burners for furnaces and the like which employ pulverized coal or other hydrocarbon fossil fuel as a source of energy for combustion:

| | | | |
|---|---|---|---|
| 246,321 | Litchfield et al | 3,150,710 | Miller |
| 1,073,463 | Banes | 3,250,236 | Zelinski |
| 1,342,135 | Schmidt | 3,283,801 | Blodgett et al |
| 1,779,647 | Van Brunt | 3,284,008 | Miller |
| 1,817,911 | Andrews et al | 3,401,675 | Miller |
| 1,953,090 | Vroom | 3,349,826 | Poole et al |
| 1,993,901 | Silley | 3,450,504 | Korwin |
| 2,046,767 | Campbell | 3,782,884 | Shumaker |
| 2,158,521 | Nahigyan | 3,788,797 | Mayfield et al |
| 2,190,190 | Peterson | 3,934,522 | Booker |
| 2,284,708 | Woolley | 4,019,851 | Smith et al |
| 2,325,318 | Hendrix | 4,050,879 | Takahashi et al |
| 2,823,628 | Poole et al | 4,089,682 | Blackburn |
| 3,007,084 | Thomasian et al | 4,147,116 | Graybill |
| 3,147,795 | Livingston et al | 4,157,889 | Bonnel |
| 4,228,747 | Smirlock et al | 4,206,712 | Vatsky |
| 4,221,558 | Santisi | 4,321,034 | Taccone |
| 4,333,405 | Mitchelfelder et al | | |

OBJECTS OF THE INVENTION

It is an object of the present invention to provide a new and improved furnace construction adapted for burning pulverized coal in an efficient, economic and non-polluting manner.

Another object of the present invention is to provide a new and improved burner for pulverized coal and more particularly, a burner having means for selective control of $NO_x$ formation and overall combustion performance.

Another object of the present invention is to provide a new and improved method of burning pulverized coal in an efficient and economical manner with a reduction and minimization of the formation of oxides of nitrogen.

Yet another object of the present invention is to provide a new and improved burner including a tertiary air system and more particularly, a tertiary air system wherein at least one tertiary air stream may be selectively and directionally controlled to move toward and away from a primary combustion zone to control the formation of $NO_x$ and to effect localized stoichiometric control at the burner discharge to increase overall combustion performance.

Yet another object of the present invention is to provide a new and improved furnace of the character described having no need or requirement for a throat or quarl formed of refractory material and more particularly, a burner and furnace combination wherein hot recirculating gases are moved into the primary combustion zone for improving ignition of pulverized coal and promoting good flame stabilization, thus eliminating the need for a refractory throat or quarl to provide a heat sink for improving coal ignition.

Yet another object of the present invention is to provide a new and improved furnace, a burner and a method for burning pulverized coal in a highly efficient and economical manner with a minimum of pollutants being generated in the process.

BRIEF SUMMARY OF THE INVENTION

The foregoing and other objects and advantages of the present invention are accomplished in a new and improved furnace, burner and method for burning pulverized coal in an efficient and economical manner which minimizes the formation of $NO_x$ and other pollutant material. The apparatus comprises a burner having a tubular nozzle with an inlet for receiving and an outlet for discharging a primary flowing stream of coal and air mixture for burning in the combustion zone of the furnace. The primary air and coal mixture passes through an annular venturi-like flow section having an outlet end comprising a divergent flow section downstream of a venturi throat. A coal spreader is mounted in coaxial alignment in the divergent flow section and has an outer end adjacent the outlet of the coal nozzle, thus providing a spreading wall surface which cooperates with the divergent flow section wall to form a diverging, frustoconical, annular-shaped flow passage. Swirl vane flow dividers are positioned in the passage to divide and separate the homogenous mixture of coal and air in a swirling action into distinct streams of fuel rich and fuel lean zones for controlled combustion in the primary combustion zone of the furnace.

A tubular conduit for secondary air is mounted in coaxial alignment around the coal nozzle outlet and directs a swirling flow of secondary air into the combustion zone around the streams of primary air coal and coal mixture discharged from the coal nozzle outlet. A plurality of tertiary air conduits are spaced radially outwardly of the tubular secondary air conduit and each has an outlet port adapted to discharge a stream of tertiary air into the combustion zone. A vane assembly is mounted in each of the tertiary conduits and is movable to directionally control a stream of tertiary air for movement toward or away from the primary air and coal combustion zone so that precision control of $NO_x$ and combustion performance may be achieved.

A pair of burners are mounted on downwardly and outwardly sloping segments of opposite sidewall surfaces of the furnace wall so that hot combustion gases may be recirculated to pass upwardly along the inside face of the sloping sidewall surfaces to supply heat for aiding the primary combustion of the coal in the combustion zone adjacent the nozzle outlets of the burners. The customary requirement for a quarl in the furnace wall formed of refractory material to act as a heat sink is eliminated along with the customary maintenance problems commonly associated with quarls formed of refractory material. The controllable vane assemblies in the tertiary air ports provide a means for fine tuning the localized stoichiometry in the combustion zone so that precision control of the combustion process and flame pattern is obtained resulting in a minimization of the formation of $NO_x$ (oxides of nitrogen) and other pollutants in the burning process.

BRIEF DESCRIPTION OF THE DRAWINGS

For better understanding of the present invention, reference should be had to the following description taken in conjunction with the drawings, in which.

DESCRIPTION OF A PREFERRED EMBODIMENT

Figure 1:
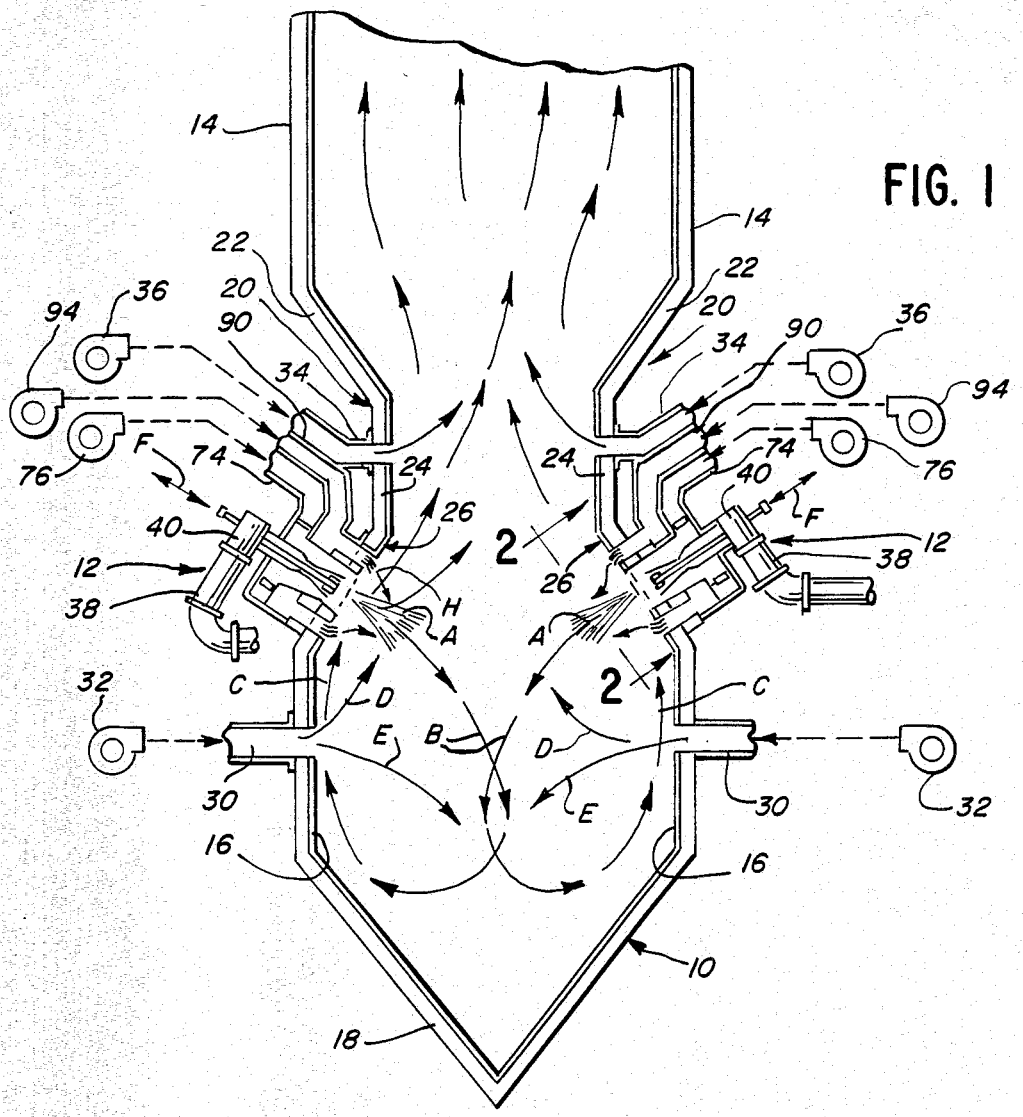
FIG. 1 is a vertical, cross-sectional view of a new and improved furnace construction in accordance with the features of the present invention.

Referring now more particularly to the drawings, in FIG. 1 is illustrated a new and improved furnace for burning pulverized coal referred to generally by the reference numeral 10 and constructed in accordance with the features of the present invention. The furnace 10 includes a pair of tertiary staged venturi burners 12 (TSV) shown in greater detail in FIGS. 3 and 4 and mounted on respective, opposite sidewalls 14 of the furnace having an inner wall surface covered by a plurality of water tubes 16 forming a water wall on the interior of the furnace housing.

The furnace housing includes a V-shaped, dry bottom, formed by a wall 18 joined to the lower edge or end portion of the opposite sidewalls 14. Each side wall is formed with an inwardly offset or pinched-in segment 20 at an intermediate level spaced above the bottom of the furnace, and each pinched-in segment includes an upper, downwardly and inwardly sloping portion 22, an intermediate vertical portion 24 spaced inwardly of the outer portion of the sidewalls, and a lower, downwardly and outwardly sloping wall segment 26 upon which is mounted a respective tertiary staged venturi burner 12.

When fired up, each tertiary staged burner develops a primary combustion zone "A" directed downwardly and inwardly as indicated by the arrows "B" so that the hot products of combustion in the flame area are impinging upon one another from an opposite burner and deflected downwardly toward the upwardly and outwardly sloping surfaces of the V-shaped bottom wall 18.

The sloping surfaces of the bottom wall deflect the flow of hot products of combustion upwardly as indicated by the arrows "C" to move past the inside faces of the burner supporting, sloping wall segments 26 and thus the hot products of combustion recirculate directly past and into the primary combustion zones "A" to provide additional heat for aiding in ignition and burning of the pulverized coal supplied from the opposing TSV burners 12.

Because of this recirculation, the need for a "heat sink" in the form of a quarl of refractory material in the furnace wall around the burner nozzle is eliminated and the troublesome maintenance problems associated with these quarls are obviated.

After the hot products of combustion pass by the primary combustion zones "A" along the inside surface of the sloped wall segments 26, the products move generally upward through a narrow throat segment 28 of the furnace housing formed by the pinched-in wall portions 20 at a level above the tertiary staged venturi burners 12. The hot gases pass on upwardly to heat the water tubes of the boiler in the upper end of the housing (not shown). Turbo R furnaces having a venturi-like, wall shape have been developed and manufactured by the assignee of the present application and U.S. Pat. Nos. 3,283,801 and 3,401,675 relate to furnaces of this similar sidewall shape having flat bottom walls. These patents are incorporated herein by reference.

Lower staged combustion air is supplied to a lower end portion of the furnace 10 through inlet ducts 30 to intermix with the recirculating hot products of combustion and move upwardly and downwardly as indicated by the arrows "D" and "E". Lower stage combustion air is supplied to the ducts 30 by suitable means such as blowers 32 or plenum chambers.

Upper level staged combustion air is supplied to a narrow throat portion 28 of the venturi furnace through upper stage combustion air inlet ducts 34 attached openings in to the intermediate, vertical wall segments 24 of the furnace sidewall 14. Upper stage combustion air is supplied to the furnace from a suitable source such as a blower 36 or plenum chamber.

Figure 3:
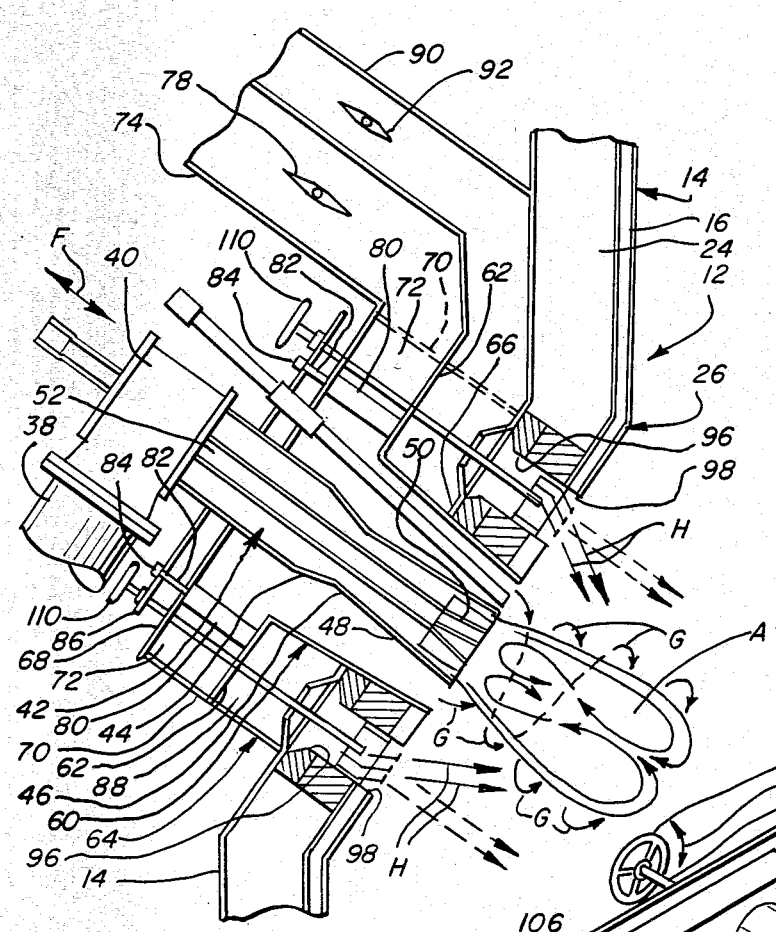
FIG. 3 is a fragmentary, cross-sectional view taken substantially along lines 3—3 of FIG. 2.
Figure 4:
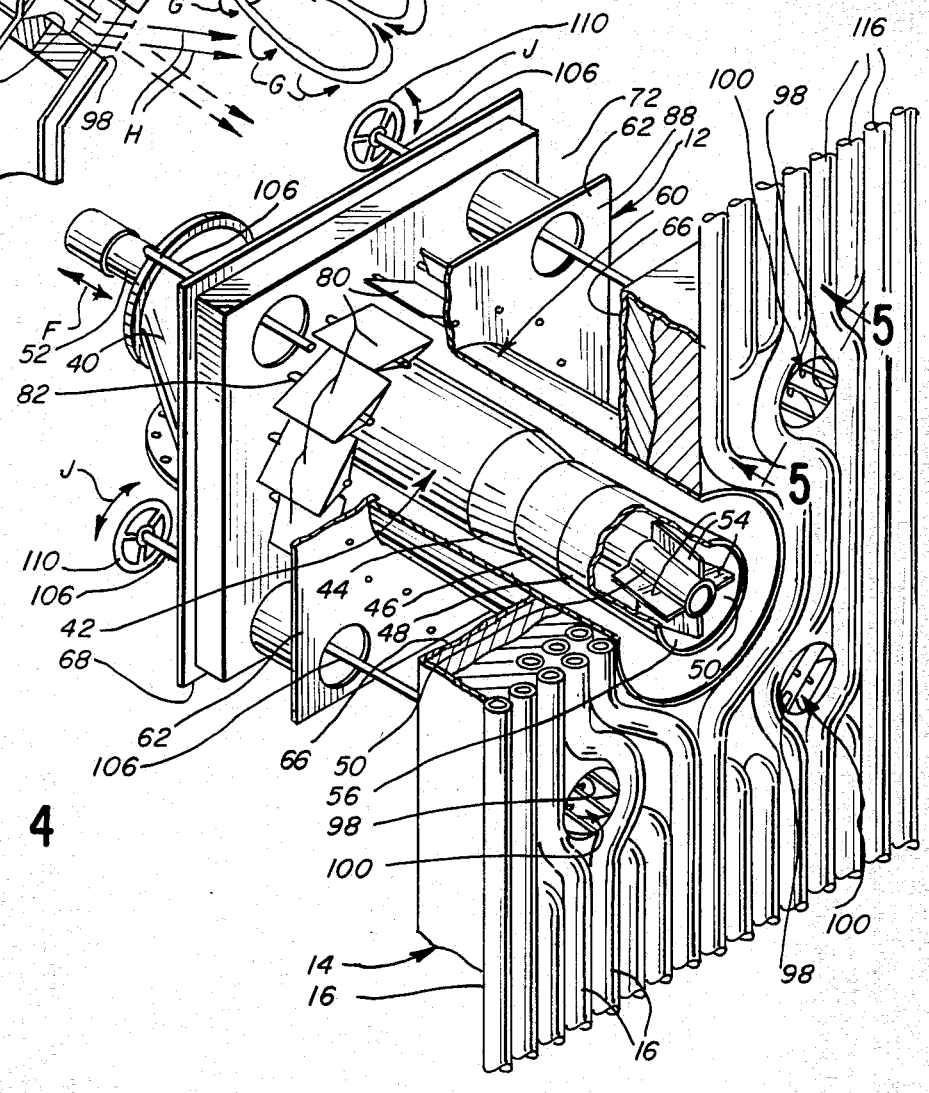
FIG. 4 is a fragmentary, perspective view of a new and improved, tertiary staged venturi burner constructed in accordance with the features of the present invention with portions shown in section and cut away for clarity.

Pulverized coal and primary combustion air is supplied through conduits or pipes 38 from a ball mill or other source to a coal head 40 of each TSV burner 12. The primary coal/air mixture is directed from the coal head down a tubular coal nozzle 42 having an outlet end adjacent or flush with the inside face of the furnace wall segment 26 as shown in FIGS. 3 and 4. The primary coal/air nozzle 42 includes a venturi-like segment adjacent the outlet having a convergent wall section 42, a minimum diameter throat 46, and a shallow-sloped, outwardly flaring divergent outlet section 48 forming a discharge outlet for the primary stream of coal and air for combustion.

The discharging stream of pulverized coal and primary air is directed to swirl around a coal spreader 50 mounted in coaxial alignment within the outwardly divergent, venturi outlet section 48 of the coal nozzle structure 42. The coal spreader 50 is open at the outer end as shown in FIG. 4 and is mounted on a support conduit or rod 52 for axial adjustment relative to the coal nozzle outlet. The coal spreader support member 52 projects rearwardly of the coal head 40 and is movable along a longitudinal axis in the direction indicated by the arrows "F" in order to tune and adjust the flame pattern in the combustion zone "A".

A plurality of swirl vanes 54 are mounted on the outside surface of the coal spreader 50 in order to divide the primary coal/air stream and impart swirling action to a plurality of fuel rich and fuel lean individual streams of coal and air passing through the annulus defined between the inner wall of the divergent venturi section 48 and the outer wall surface of the coal spreader 50. The coal spreader and vanes develop a swirling, gradually expanding conical discharge from the coal nozzle outlet into the combustion zone "A". The vanes 54 divide the annular area at the coal nozzle into a plurality of circumferentially spaced discharge passages 56 on opposite sides of each vane. This arrangement results in a gradually expanding annulus of swirling coal and primary air mixture entering into the combustion zone "A" for ignition and burning in a stable elongated flame pattern. The hollow end of the coal spreader 50 provides a low pressure area of high temperature and reducing atmosphere wherein the volatiles are rapidly driven off without any substantial formation of oxides of nitrogen.

In accordance with the present invention, the outlet end of the coal nozzle 42 is surrounded by a frustoconically-shaped, secondary air conduit 60 having an outlet end in coaxial alignment with the discharge end of the primary coal nozzle and flush with or adjacent to the inside surface of the furnace wall 26. Secondary air flow passing through the conduit 60 is formed into a swirling annulus which is discharged from the outlet end surrounding the coaxial discharge of the primary air and coal mixture from the coal nozzle 42.

The inlet end of the secondary air conduit 60 is supplied with secondary air through a circular opening in a rectangular/square shaped divider plate 62 provided in a large, rectangular shaped housing or plenum 64 having a forward wall 66 secured to an outside wall surface of the furnace sidewall segment 26 in parallel relation with the divider plate 62. The box-like housing also includes a backwall 68 of similar outline and the parallel walls and the divider plate are innerconnected around the periphery with a sidewall 70.

An open area or space in the burner housing between the divider wall 62 and the backwall 68 comprises a plenum chamber 72 for secondary air to be discharged into the secondary air conduit 60 in a swirling pattern for ultimate discharge into the combustion zone "A" around the primary air and coal from the coal nozzle 42 (as indicated by the arrows "G" in FIG. 3). Secondary air for the plenum chamber section 72 is introduced through a secondary air supply duct 74 connected to a sidewall 70 of the chamber and supplied from a suitable source of air such as blower 76 or a plenum chamber of suitable capacity. An adjustable control vane 78 is mounted in the supply duct 74 for controlling the air flow supplied to the secondary air plenum 72 of each TSV burner.

Swirling action is imparted to the secondary air flowing from the plenum 72 through the central aperture of the divider plate 62 into the slightly convergent, secondary air conduit nozzle structure 60 by a ring of individually controllable swirl vanes 80 arranged in a concentric pattern around the central axis of the coal nozzle 42. Each vane 80 is individually controllable by means of a control shaft 82 having an outer end projecting outwardly through the backwall 68 of the plenum and securable in a selected rotative position by a lock nut 84 which may be tightened against a lock ring 86 (FIG. 3).

In accordance with the invention, a tertiary air plenum 88 is formed in the box-like plenum 64 between the forward wall 66 and the divider wall 62. Tertiary air is supplied to a sidewall 70 of the plenum 88 through a tertiary air supply duct 90 having a control vane 92 mounted therein. Tertiary air is provided for the inlet duct 90 from a suitable supply source such as fans 94 or plenums (not shown).

Figure 2:
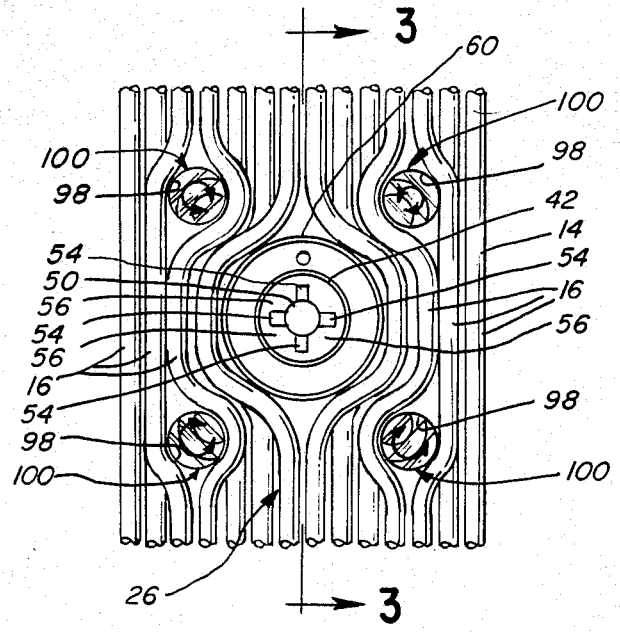
FIG. 2 is a fragmentary, inside elevational view of a segment or portion of the furnace wall looking in the direction of the arrows 2—2 of FIG. 1.

Tertiary air is introduced into the combustion zone "A" for controlling and fine tuning the shape of the flame pattern, controlling the formation of $NO_x$, and for controlling the overall combustion process through a plurality of tubular tertiary air conduits 96 formed in coaxial alignment with openings 66*a* (FIG. 5) provided in the forward wall 66 of the burner plenum 64. The conduits 96 are formed in the sloped segments 26 of the furnace sidewall 14 and are arranged in an equilateral pattern spaced radially outwardly around the central axis of the coal nozzle 42 as best shown in FIG. 2. Each conduit terminates in an outer discharge port 98 formed in the water wall structure on the inside of the furnace wall and each port 98 is fitted with a rotatably mounted vane assembly 100 for individualized selective control of a tertiary air stream "H" (FIG. 3) for movement toward and away from the combustion zone "A" and a central axis of the flame pattern.

The selectively controlled impingement of one or more tertiary air streams upon the combustion process taking place in zone "A" is effective to locally control the stoichiometry of the combustion and eliminate or minimize the unwanted formation of $NO_x$ or other pollutant materials.

Figure 5:
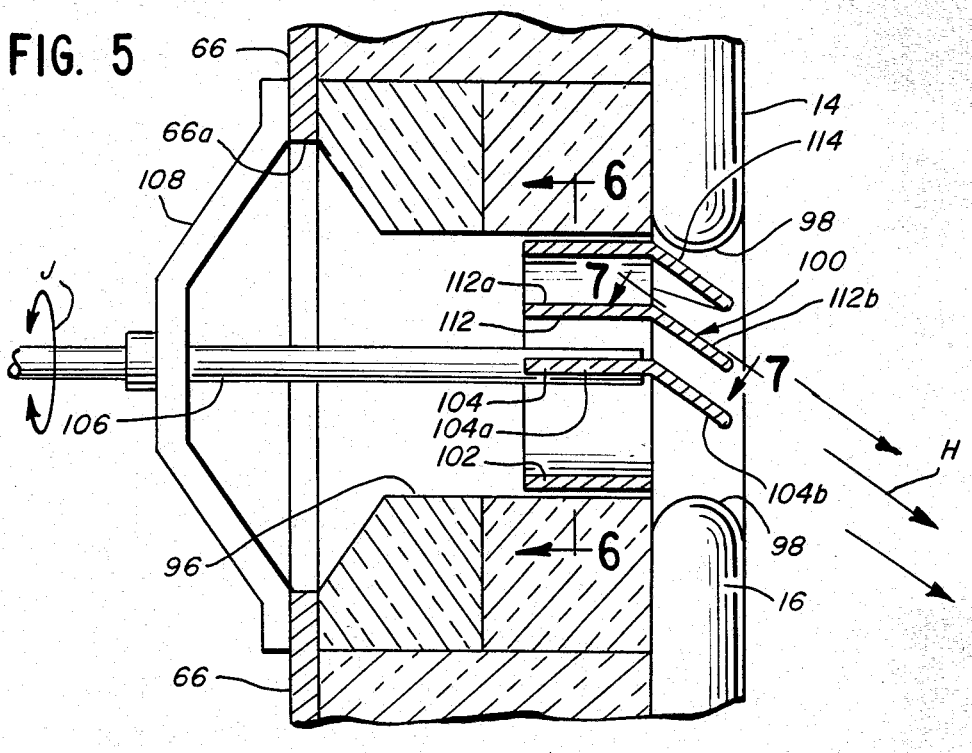
FIG. 5 is a fragmentary, cross-sectional view taken substantially along lines 5—5 showing construction details of a tertiary air conduit and control vane assembly therein in accordance with the features of the present invention.
Figure 6:
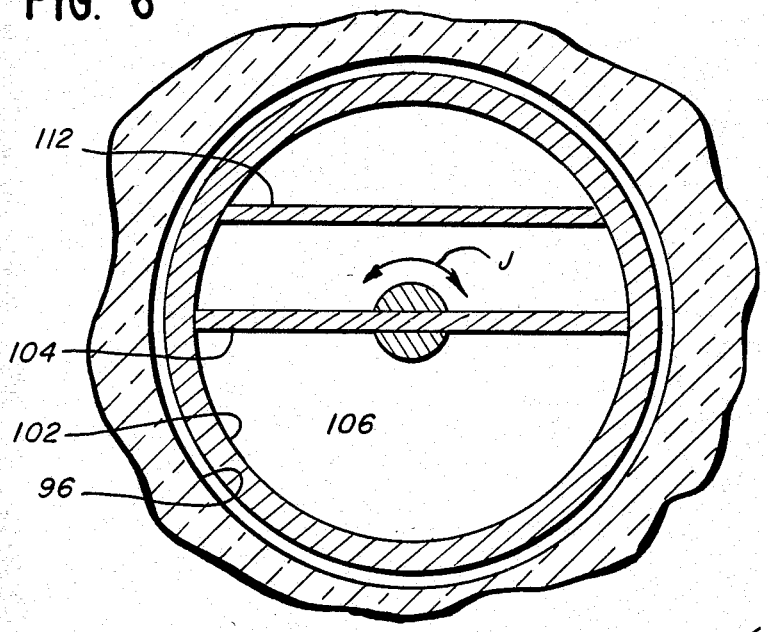
FIG. 6 is a cross sectional view taken substantially along lines 6—6 of FIG. 5.

Each vane assembly 100 includes an annular cylindrical ring 102 having a diametrically extending central vane 104 therein as shown in FIGS. 5 and 6. An inner portion 104*a* of the vane 104 is secured to the forward end of a control shaft 106 which is journalled for 360° rotation in a support bracket 108 attached to the forward wall 66 of the burner housing 64. The control shafts 106 are coaxially aligned with the respective vane rings 102 and project rearwardly through the divider plate 62 and backwall 68 of the burner housing. Outwardly projecting ends of the control shafts are provided with hand wheel controls 110 so that each individual vane assembly 100 may be selectively rotated through 360° as indicated by the arrows "J".

Figure 7:
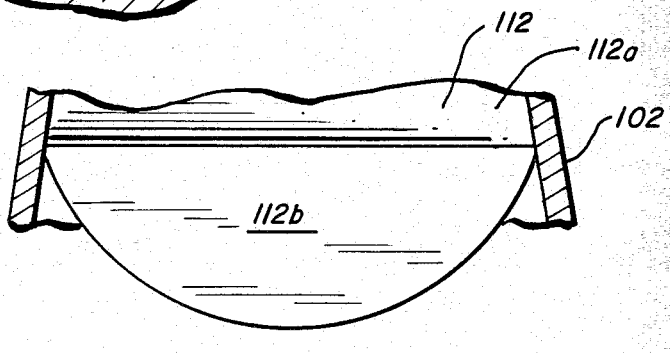
FIG. 7 is a fragmentary, cross-sectional view taken substantially along lines 7—7 of FIG. 6.

The center vane 104 also includes an outer portion 104*b* having a curved outer edge and positioned at an acute angle with respect to the longitudinal axis of the control shaft 106. At least one other intermediate vane 112 is provided in the cylindrical vane ring 102 and the intermediate vane includes an inner portion 112*a* parallel of the diametrical inner portion 104*a* of the central vane 104. Similarly, the vane 112 has an outer portion 112*b* having a curved outer edge best shown in FIG. 7 and is aligning in parallel with the outer vane portion 104*b* so as to aid in deflecting a stream "H" of tertiary air toward and away from the primary combustion zone "A" dependent upon the rotational position of the vane assembly 100 in its respective tertiary air port 98. Additional sets of deflector vanes may be provided such as the outermost deflector vane 114.

It will thus be seen that rotation of the control shaft 106 by the individual hand wheels 110 in back of the burner housing 64 is effective to control the angular displacement of the tertiary air streams "H" entering the combustion zone. By movement of a control wheel to a selected rotational position, the shape of the combustion flame pattern and the local stoichiometry of the process may be trimmed and controlled to produce maximum efficiency and a minimum formation of $NO_x$ and other pollutants in the burning process.

Figure 8:
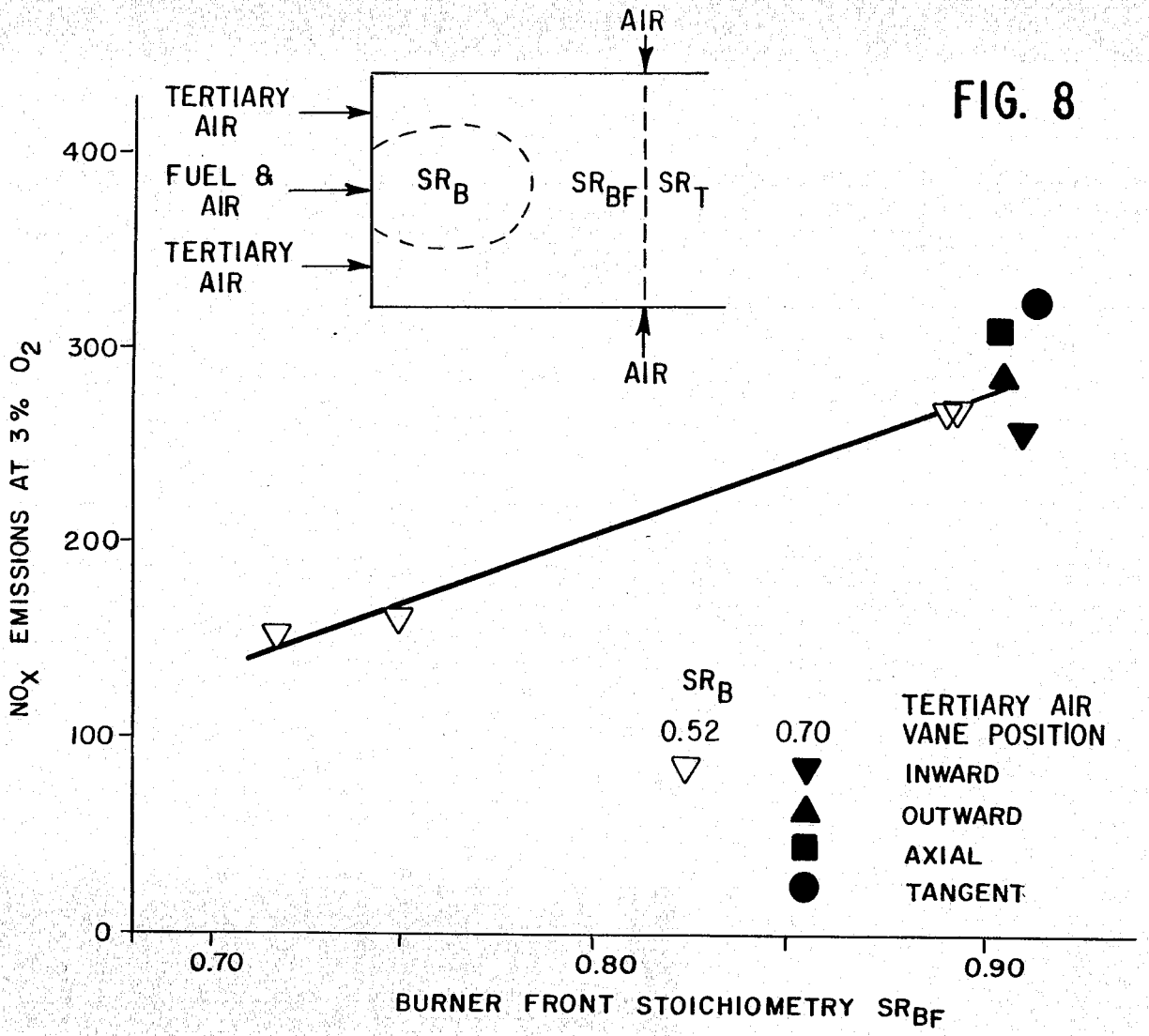
FIG. 8 is a graphic representation of the operating characteristics of tertiary staged venturi burners in accordance with the invention.

Referring to FIG. 8, the TSV burners 12 are stabilized by recirculation between primary and secondary flows achieved at a medium range swirl number and the burners are designed so that the stoichiometric ratio of the secondary air in the conduit 60 around the coal nozzle 42 can be reduced to 0.4. The secondary air admitted into the narrow annulus between the walls of the conduits 60 and 42 through the register vanes 80 provides the necessary swirl for the secondary air flow. The burners 12 do not have an expanding quarl, and accordingly the burner annulus may be flush with the furnace wall. The tertiary air ports 98 equipped with the directional turning vane assemblies 100 are positioned near the secondary air conduit 60 and these tertiary ports are used to bring the total burner front stoichiometry ($SR_{BF}$) up to 0.7–1.0. The remainder of air flow needed is added through the downstream air staging ports or inlets 30 and 34.

The burner adjustments used on the TSV Burners 12 include (1) the position of the register vanes 80 (2) the axial position of the coal spreader 50 and (3) the angles of the tertiary air control turning vane assemblies 100 relative to the burner axis.

In operational testing, with the spreader 50 in optimized position the flame is very well rooted at the coal nozzle when the register vanes 80 are in positions less than 25° from tangent to the concentric circular ring of vanes and $NO_x$ emissions were lowest at a register vane position of about 25°. A swirl number measured during the aerodynamic model testing at this setting was 0.6. As the register vanes 80 are opened, swirl is decreased, the flame front becomes detached from the burner nozzles, and $NO_x$ emissions increased from 300 ppm to 500 ppm. The position of the coal spreader also has an effect on $NO_x$. $NO_x$ emissions dropped by 275 ppm when the spreader 50 was flush with the tip of the coal nozzle 42. The drop in $NO_x$ generation was accompanied by elimination of flame stand-off. $NO_x$ emissions were highest with the tertiary air vanes set so that the tertiary flow was injected tangent to the swirling flame. With the tertiary air directed radially into the flame, $NO_x$ was slightly lower. $NO_x$ dropped by 25% when the tertiary air was directed away from the flame.

$NO_x$ emissions are very sensitive to localized stoichiometry and the lowest $NO_x$ emissions achieved were 156 ppm at $SR_{BF}=0.71$. CO emissions for the burner were low in the range of 15–20 ppm with no apparent dependency on $NO_x$ emissions. Burner adjustment settings have a relatively large effect on $NO_x$ emissions and changing the spreader position has an effect on the flame shape and $NO_x$ generation, particularly with the spreader 50 in adjusted position wherein there is no stand-off of the flame and a swirl number for secondary air greater than 0.6. Adjustments of the register vanes 80 and the position of the spreader 50 can reduce $NO_x$ by 40% and reducing the burner front stoichiometry also has an effect in reducing total burner front stoichiometry from 0.9 to 0.7. This reduction resulted in reduced $NO_x$ by 50%.

Although the present invention has been described with reference to a single illustrated embodiment thereof, it should be understood that numerous other modifications and embodiments can be made by those skilled in the art that will fall within the spirit and scope of the principles of this invention.

What is claimed as new and is desired to be secured by Letters Patent is:

1. A burner for pulverized coal comprising:

tubular nozzle means having an inlet for receiving a primary flowing stream of coal and air mixture and an outlet end for discharging said stream into a combustion zone of a furnace for burning;

annular, venturi-like flow control means in said nozzle means coaxially disposed adjacent said outlet end, said flow control means having a divergent flow section with a maximum diameter outlet adjacent said outlet end of said nozzle means and a convergent flow section upstream thereof for more evenly distributing said pulverized coal in the center portion of said stream;

coal spreader means mounted in coaxial alignment in said divergent flow section having an end adjacent said outlet end and a wall surface cooperating with wall surfaces of said divergent flow section to form a diverging, frusto-conical annular-shaped flow passage;

swirl vane flow divider means positioned in said passage between said coal spreader means and surfaces of said divergent flow section for dividing said homogenous mixture of coal and air in a swirling action into distinct streams of fuel rich and fuel lean zones for discharge into said combustion zone;

a tubular conduit in coaxial alignment with said tubular nozzle means having an inlet for secondary air and an outlet adjacent said outlet end of said tubular nozzle means for discharging an annular flow of secondary air into said combustion zone around said streams of said coal and air mixture discharged into said combustion zone;

a plurality of tertiary air conduits spaced radially outwardly of said tubular conduit, each having an outlet port for discharging a stream of tertiary air into said combustion zone; and vane means in each of said tertiary air conduits movable to direct a stream of tertiary air into or away from the primary coal and air mixture discharging into said combustion zone for $NO_x$ control and combustion performance.

2. The burner of claim 1 wherein said vane means is mounted for rotational movement around a central axis in each said tertiary conduit and includes at least one deflector vane in angular relationship with said axis.

3. The burner of claim 2 including control means for selectively controlling the rotative position of said vane means in a respective tertiary conduit.

4. The burner of claim 3 wherein said control means includes a shaft aligned along said central axis of each of said tertiary conduits.

5. The burner of claim 2 wherein said vane means in each tertiary conduit includes a plurality of said deflector vanes in parallel alignment with each other across said respective outlet port.

6. The burner of claim 2 wherein said vane means in each tertiary conduit includes a cylindrical body rotatively received in said conduit.

7. The burner of claim 6 wherein said vane means in each tertiary conduit includes a plurality of parallel deflector vanes extending across said cylindrical body for dividing the tertiary air flow into separate streams and deflecting said streams discharging from said respective teritary port with respect to said axis of said tertiary air conduit.

8. A method of burning pulverized coal comprising the steps of:

passing a primary flow of coal and air mixture through a venturi-like structure for discharge at the outlet of a coal nozzle into a combustion zone;

directing said primary flow of coal and air mixture to swirl around a centrally positioned coal spreader to form a stable, annular, expanding frusto-conically shaped, flow pattern of fuel rich and fuel lean streams discharging into said combustion zone;

introducing a swirling flow of secondary air around said streams discharging into said combustion zone from said coal nozzle; and directionally controlling a stream of tertiary air from one or more ports spaced outwardly of the region of secondary air introduction around said coal nozzle by movement toward and away from the combustion zone to locally affect the stochimometry of the combustion process for controlling the formation of $NO_x$ and the combustion performance of the coal burning said combustion zone.

9. The method of claim 8 the step of directionally controlling the tertiary air streams includes angular movement thereof with respect to a central axis of said combustion zone.

10. The method of claim 9 wherein said step of introducing said swirling flow of secondary air creates a torroidal recirculation zone around a stabilized annular flow pattern of primary coal and air discharged into said combustion zone.

11. A furnace fired with pulverized coal, comprising:

a pair of opposite sidewalls sloping downwardly and outwardly away from one another at a level above a bottom wall, said bottom wall including a deflection surface for directing products of combustion upwardly across an inside face of said sloping opposite side walls; and at least one burner for pulverized coal, mounted on each of said sloping sidewalls for directing a primary coal and air mixture into a combustion zone adjacent said sidewall in a downward direction generally normal to said sidewall;

each of said burners including:

tubular nozzle means having an inlet for receiving a primary flowing stream of coal and air mixture and an outlet end for discharging said stream into a combustion zone of a furnace for burning;

annular, venturi-like flow control means in said nozzle means coaxially disposed adjacent said outlet end, said flow control means having a divergent flow section with a maximum diameter outlet adjacent said outlet end of said nozzle means and a convergent flow section upstream thereof for more evenly distributing said pulverized coal in the center portion of said stream;

coal spreader means mounted in coaxial alignment in said divergent flow section having an end adjacent said outlet end and a wall surface cooperating with wall surfaces of said divergent flow section to form a diverging, frusto-conical annular-shaped flow passage;

swirl vane flow divider means positioned in said passage between said coal spreader means and surfaces of said divergent flow section for dividing said homogenous mixture of coal and air in a swirling action into distinct streams of fuel rich and fuel lean zones for discharge into said combustion zone;

a tubular conduit in coaxial alignment with said tubular nozzle means having an inlet for secondary air and an outlet adjacent said outlet end of said tubular nozzle means for discharging an annular flow of secondary air into said combustion zone around said streams of said coal and air mixture discharged into said combustion zone;

a plurality of tertiary air conduits spaced radially outwardly of said tubular conduit, each having an outlet port for discharging a stream of tertiary air into said combustion zone; and vane means in each of said tertiary air conduits movable to direct a stream of tertiary air into or away from the primary coal and air mixture discharging into said combustion zone for $NO_x$ control and combustion performance.

12. The furnace of claim 11 wherein said vane means is mounted for rotational movement around a central axis in each said tertiary conduit and includes at least one deflector vane in angular relationship with said axis.

13. The furnace of claim 12 including control means for selectively controlling the rotative position of said vane means in a respective tertiary conduit.

14. The furnace of claim 13 wherein said control means includes a shaft aligned along said central axis of each of said tertiary conduits.

15. The furnace of claim 12 wherein said vane means in each tertiary conduit includes a plurality of said deflector vanes in parallel alignment with each other across said respective outlet port.

16. The furnace of claim 12 wherein said vane means in each tertiary conduit includes a cylindrical body rotatively received in said conduit.

17. The furnace of claim 16 wherein said vane means in each tertiary conduit includes a plurality of parallel deflector vanes extending across said cylindrical body for dividing the tertiary air flow into separate streams and deflecting said streams discharging from said respective tertiary port with respect to said axis of said tertiary air conduit.

18. The furnace of claim 11 wherein:

said tubular conduit for secondary air of each burner is mounted with said outlet thereof adjacent said inside face of the adjacent sidewall.

19. The furnace of claim 11 wherein:

the combustion zone of each burner adjacent the outlet end of said nozzle means receives heat from recirculating products of combustion flowing upwardly across the inside face of said sidewall.

* * * * *